US005271255A

United States Patent [19]

Thompson

[11] Patent Number: 5,271,255

[45] Date of Patent: Dec. 21, 1993

[54] METHOD TO CONTROL AND MONITOR A PRESSURE POT SHOT PEENING SYSTEM

[75] Inventor: Robert A. Thompson, Quaker Street, N.Y.

[73] Assignee: General Electric Company, Schenectady, N.Y.

[21] Appl. No.: 930,955

[22] Filed: Aug. 17, 1992

[51] Int. Cl.[5] ..... B24C 1/10

[52] U.S. Cl. ..... 72/53; 29/90.7; 51/319

[58] Field of Search ..... 72/53; 29/90.7; 51/319

[56] References Cited

U.S. PATENT DOCUMENTS

| | | | |
|---|---|---|---|
| 4,420,957 | 12/1983 | Weber | 72/53 |
| 4,552,017 | 11/1985 | Biehle | 72/53 |
| 4,614,100 | 9/1986 | Green et al. | 72/53 |
| 4,805,429 | 2/1989 | Thompson | 72/53 |
| 4,873,855 | 10/1989 | Thompson | 72/53 |

*Primary Examiner*—David Jones

*Attorney, Agent, or Firm*—Paul R. Webb, II

[57] ABSTRACT

This invention relates to a method and apparatus for controlling and monitoring pressure pot shot peening machines. Such structures of this type, generally, allow the user to determine and control the force of the shot as it leaves the shot peening nozzle.

1 Claim, 2 Drawing Sheets

METHOD TO CONTROL AND MONITOR A PRESSURE POT SHOT PEENING SYSTEM

BACKGROUND OF THE INVENTION

1. Field of the Invention

This invention relates to a method and apparatus for controlling and monitoring pressure pot shot peening machines. Such structures of this type, generally, allow the user to determine and control the force of the shot as it leaves the shot peening nozzle.

2. Description of the Related Art

The use of shot peening is relatively well known. In particular, a stream of shot (i.e., particles) is directed at the surface at a high velocity. The shot is directed at a workpiece so as to cause plastic deformation of the surface of the workpiece, often a metal surface. The shot peening is often used to increase fatigue strength, although the process may be applied for other purposes.

Various shot peening devices and techniques have been developed over the years. Shot peening systems, generally, have (or can be readily equipped with) mass flow controllers. Such controllers are used to control the flow of shot to the shot peening gun. One common type of mass flow controller for use with shot made from magnetic material has an electromagnet which is pulsed in order to allow passage of a metered amount of shot into a shot peening gun. This common type of mass flow controller uses internal feedback to stabilize the mass flow rate (i.e., the amount of shot metered in a given time). A control may be used to set the mass flow rate to a desired value. A display may be used to indicate the flow rate.

Although the mass flow rate is useful information, it is insufficient by itself to give an indicate of the quality of the shot peening applied to a particular surface.

Although some measurement techniques have been used in conjunction with the shot peening process, such prior techniques have been inadequate to conveniently and inexpensively provide an indication of the quality of a shot peening technique. The general absence of simple and inexpensive techniques to measure the quality of shot peening inhibits one's confidence that consistent shot peening results may be obtained. A further problem of some shot peening systems has been their inability to halt the shot peening when a nozzle is partly cogged, an air leak occurs, or some other malfunction happens.

Finally, it is known in shot peening control and monitoring systems to measure the reaction force at the nozzle by a force sensor. Exemplary of such prior art shot peening systems achieving a modicum of success in this regard is U.S. Pat. No. 4,805,429 to R. A. Thompson, which is assigned to the same assignee as the present invention. The Thompson patent discloses the importance of knowing the shot velocity in a shot peening operation. The Thompson patent further describes a way to measure shot velocity as the force required to accelerate shot from the gun divided by the mass flow rate of shot. The shot mass flow rate is measured by a commercial sensor and the reaction force by a commercial force sensor mounted at the base of the gun. A load cell mounted on the gun has several advantages, but in certain applications it also has some drawbacks. For example, in the case of a robot gun positioner's weight and acceleration affects must be reconciled as must the space needed for the sensing element. Therefore, an advantageous system would be presented if the reaction force were determined in an easier manner.

It is apparent from the above that there exists a need in the art for an apparatus and method for controlling and monitoring pressure pot shot peening machines which is capable of determining the reaction force at the nozzle, and which at least equals the pressure determination characteristics of the known systems, particularly those of the highly advantageous type disclosed in the above-referenced Thompson patent, but which at the same time determines the pressure in an easier manner. It is a purpose of this invention to fulfill this and other needs in the art in a manner more apparent to the skilled artisan once given the following disclosure.

SUMMARY OF THE INVENTION

Generally speaking, this invention fulfills these needs by providing an apparatus for controlling and monitoring pressure pot shot peening machines, comprising a pressure pot for introducing an amount of shot and air to a pressure pot gun nozzle, a shot mass flow controller means operatively connected to said pressure pot, and a pressure sensing means operatively connected to said pressure pot and said pressure pot gun nozzle.

In certain preferred embodiments, the shot mass flow controller is magnetic densitometer. Also, the pressure sensor means are an electronic pressure sensor and a pressure gauge.

In another further preferred embodiment, the reaction force of the shot at the gun nozzle is more accurately determined by measuring the pressure inside of the gun body.

The preferred control and monitoring system for a pressure pot shot peening machine, according to this invention, offers the following advantages: light weight; ease of assembly and repair; good stability; good durability; excellent force determination characteristics; good economy and high strength for safety. In fact, in many of the preferred embodiments, the factor of force determination characteristics is optimized to an extent that is considerably higher than heretofore achieved in prior, known controls and monitors for pressure pot shot peening machines.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several veins and in which.

DETAILED DESCRIPTION OF THE INVENTION

Before discussing the specifics of the preferred embodiment of the present invention, it will be useful to discuss the physics of the shot peening process. When a work piece surface is subject to plastic deformation on the shot peening process, the beneficial effect of the process depends upon the shot particle energy. Since energy depends upon the product of the particle's mass (m) and its velocity (v) squared, knowledge of the velocity (v) of a shot stream is quite helpful in quantifying the beneficial effects of applying shot peening to a particular surface.

Newton's second law of motion provides that a force (F) is equal to the change in the amount of motion, the amount of motion being mass (m) times velocity (v) which may be stated as follows:

$$F = \frac{d}{dt}(mv) = m\frac{dv}{dt} + v\frac{dm}{dt} \quad (1)$$

Typically, the above Equation (1) reduces to F=ma where (a) is the acceleration, this according to the first term of the right side of Equation (1) wherein the force (F) is applied to a body of constant mass (m). However, in the case of a shot gun under steady state conditions, the first term is zero because the velocity (v) does not change. Accordingly, the force (F) is equal to the velocity (v) times the mass differential.

The application of Equation (1) to a shot stream may be thought of as somewhat analogous to withdrawing a rope from a box by pulling at a constant velocity. The first term of the equation is zero because the time differential of the velocity is zero. However, the second term of Equation (1) would be applicable in that the mass of the rope is changing as more rope is pulled from the box. In somewhat similar fashion, the change in the amount of motion of a stream of shot is its mass flow rate times its velocity (v). Thus, the velocity (v) of a stream of shot is equal to:

$$v = F/R \quad (2)$$

where (R) is use to indicate the mass flow rate corresponding to dm/dt and (v) is the average velocity of the shot stream.

From Equation (2) above, it will be seen that the average velocity (v) of the shot stream may be calculated if the mass flow rate (R) and the force (F) of the shot stream can be calculated. The present invention senses (F) by sensing the reaction force of the shot peening gun. This reaction force is equal and opposite in direction from the force of the shot and gases which are expelled from the shot peening gun.

Figure 1:
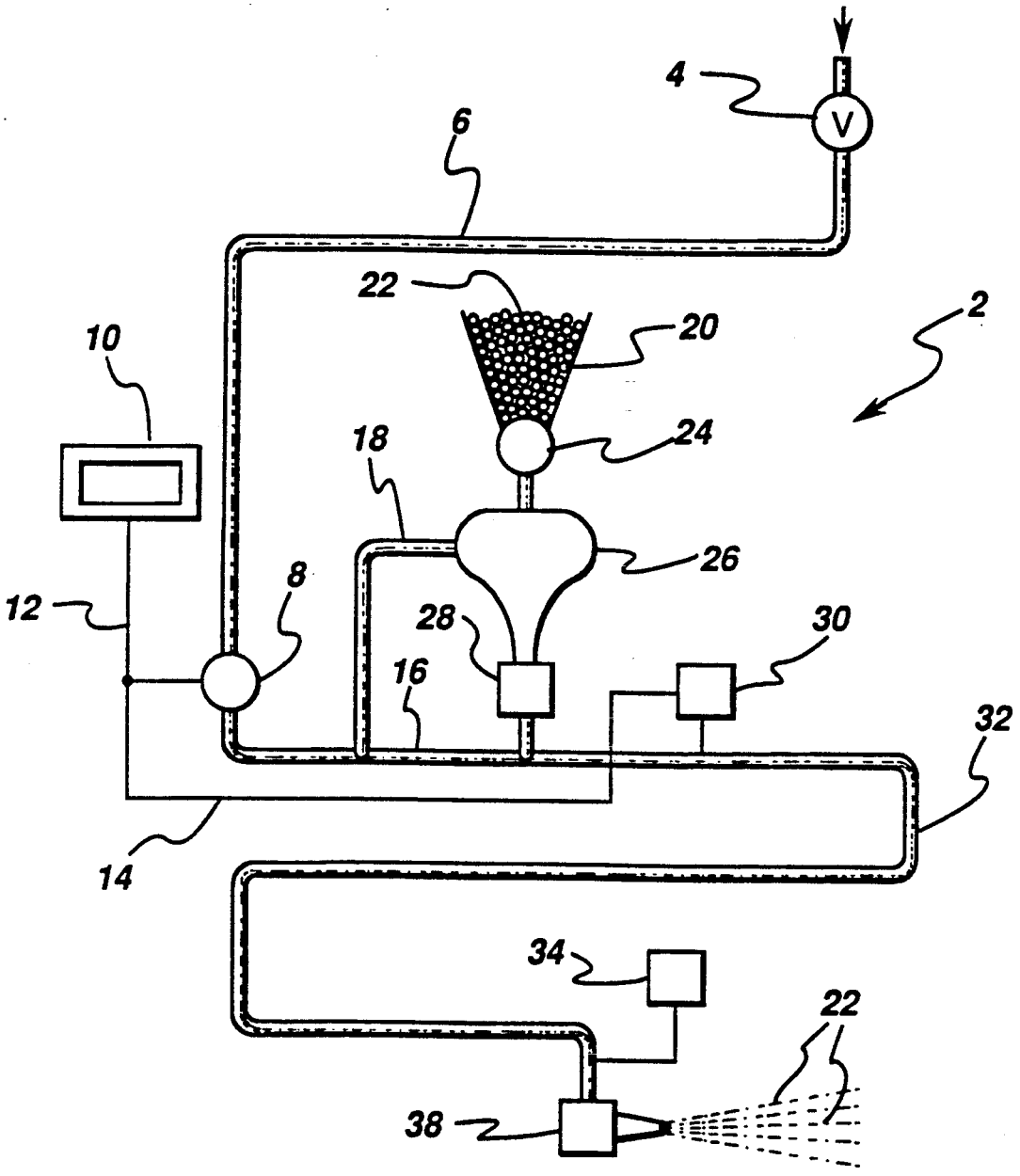
FIG. 1 is a schematic illustration of an apparatus and method to control and monitor a pressure pot shot peening machine, according the present invention.

Pressure pot machines are characterized by a single hose which carries both air under pressure and shot to the nozzle where they are accelerated to high velocity, the shot subsequently striking and doing its work on the workpiece surface. FIG. 1 shows a schematic illustration of control and monitor system 2 pressure pot shot peening machine. System 2 includes, in part, conventional manual gate valve 4, conduits 6, 16 and 32, control valve 8, pressure indicator 10, electrical leads 12 and 14, bleed line 18, shot hopper 20, shot 22, conventional valve 24, pressure pot 26, shot mass flow controller 28, pressure sensor 30, pressure gauge 34, and nozzle 38. Control valve 8, preferably, is a conventional electric control valve. Pressure indicator 10, preferably, is a conventional digital pressure indicator. Shot mass flow controller 28, preferably, is a magnetic densitometer constructed by Electronics Incorporated. Pressure gauge 34, preferably, is a Bourdon pressure gauge.

Prior to the present invention, pressure pot machines typically regulate and hold constant the air pressure at the inlet to the shot delivery hose. This arrangement, however, has serious short comings in terms of velocity (v) of the stream ejected from the nozzle because variable resistance effects in the shot delivery hose can cause pressure variations at the nozzle which affect the ultimate velocity (v) of the ejected stream and subsequent intensity of the peening operation. This effect was readily observable on a pressure pot machine when the reaction force on the gun was recorded by conventional reaction force determination techniques under a constant supply pressure conditions. The results of the measurements are shown in Table 1 below:

TABLE 1

| Test No. | Initial Pressure Pot Tests $P_1$ (psi gage) | $P_2$ (psi gage) | $\dot{m}_5$ (lb/min) | F (lb) |
|---|---|---|---|---|
| 1 | 30.4 | N/A | 0 | 2.76 |
| 2 | 29.4 | N/A | 5 | 1.81 |
| 3 | 45.5 | 30.0 | 0 | 4.09 |
| 4 | 44.9 | 22.5 | 5 | 2.97 |
| 5 | 35.0 | 22.5 | 0 | 3.02 |
| 6 | 45.0 | 22.5 | 5 | 2.95 |

In test 1, the pressure was set at $P_1$ equal to 30.4 psi and the reaction force F equal to 2.76 pounds was recorded by conventional recording techniques such as those set forth in the above-referenced Thompson patent. Next, for test 2, the pressure $P_1$ was kept essentially the same and 5 lbs/min of shot was introduced into the shot delivery hose. Instead of an expected increase in reaction force (F) due to the acceleration of added mass, the reaction force (F) decreased to F equal to 1.81 pounds. This effect was caused by a decrease in air flow in the shot delivery hose due to the added flow resistance caused by the presence of shot. This effect is clearly evident for tests 3 and 4 where $P_2$ was measured. In this case, the pressure at the nozzle available to accelerate the exiting stream of air plus shot dropped from 30.0 to 22.5 psi. Even when $P_2$ was held constant at 22.5 psi, the additional shot did not increase the total momentum ejected from the nozzle as illustrated in tests 5 and 6. The reason was, again, variable resistance effects. This behavior in pressure pot machines leads to the first principle of the invention, namely, pressure control of pressure pot machines (currently the standard practice) will lead to inconsistent performance of the shot peening process. Instead, air flow control is needed.

Under air flow control, the amount of air ejected from the nozzle 38 remains constant independent of resistance effects upstream of nozzle 38. Under constant flow conditions the pressures, $P_1$ and $P_2$, adjust themselves to accommodate constant flow. Under these conditions the reaction force due to the air ejected from the nozzle 38 is independent of the presence of shot 22 and the change in reaction force (F) due to the addition of the shot can be used as described in the above-referenced Thompson patent to measure shot velocity (v).

Table 2 illustrates test 7 where the same pressure pot machine as used in tests 1-6 was run under constant air flow conditions.

TABLE 2

| Test No. | Initial Constant Flow Pressure Pot Tests $P_0$ (psi gage) | $P_1$ (psi gage) | $P_2$ (psi gage) | $\dot{m}_5$ (lb/min) | F (lb) | Time |
|---|---|---|---|---|---|---|
| 7 | 98 | 20.1 | 12.5 | 0 | 1.66 | N/A |
| | 97 | 32.1 | 15.0 | 5 | 1.80 | N/A |
| 8 | 99 | 21.7 | 14 | 0 | 1.75 | 10:54 am |
| | 98 | 20.1 | 12.5 | 0 | 1.64 | 10:56 am |
| | 98 | 30.6 | 15 | 5 | 1.82 | 11:01 am |

TABLE 2-continued

| Test No. | $P_0$ (psi gage) | $P_1$ (psi gage) | $P_2$ (psi gage) | $\dot{m}_5$ (lb/min) | F (lb) | Time |
|---|---|---|---|---|---|---|
| | Initial Constant Flow Pressure Pot Tests | | | | | |
| | 99 | 31.1 | 15.5 | 5 | 1.83 | 11:02 am |

In this case, the initial pressure of $P_1$ equal to 20.1 psi increased to 32.1 psi with the addition of 5 lb/min of shot flow while $P_2$ went from 12.5 to 15.0 psi. At the same time, the nozzle reaction force (F) increased 0.14 pounds from 1.66 to 1.80, this force being required to accelerate the shot. Here the principles of the above-referenced Thompson patent can be used to calculate the shot velocity (v). What is more, however, is that delivery hose variations such as increase in diameter due to wear which reduce flow resistance will not effect the results because the quantity of air ejected from the nozzle and, consequently, the rejected shot stream is constant, independent of these variations.

Figure 2:
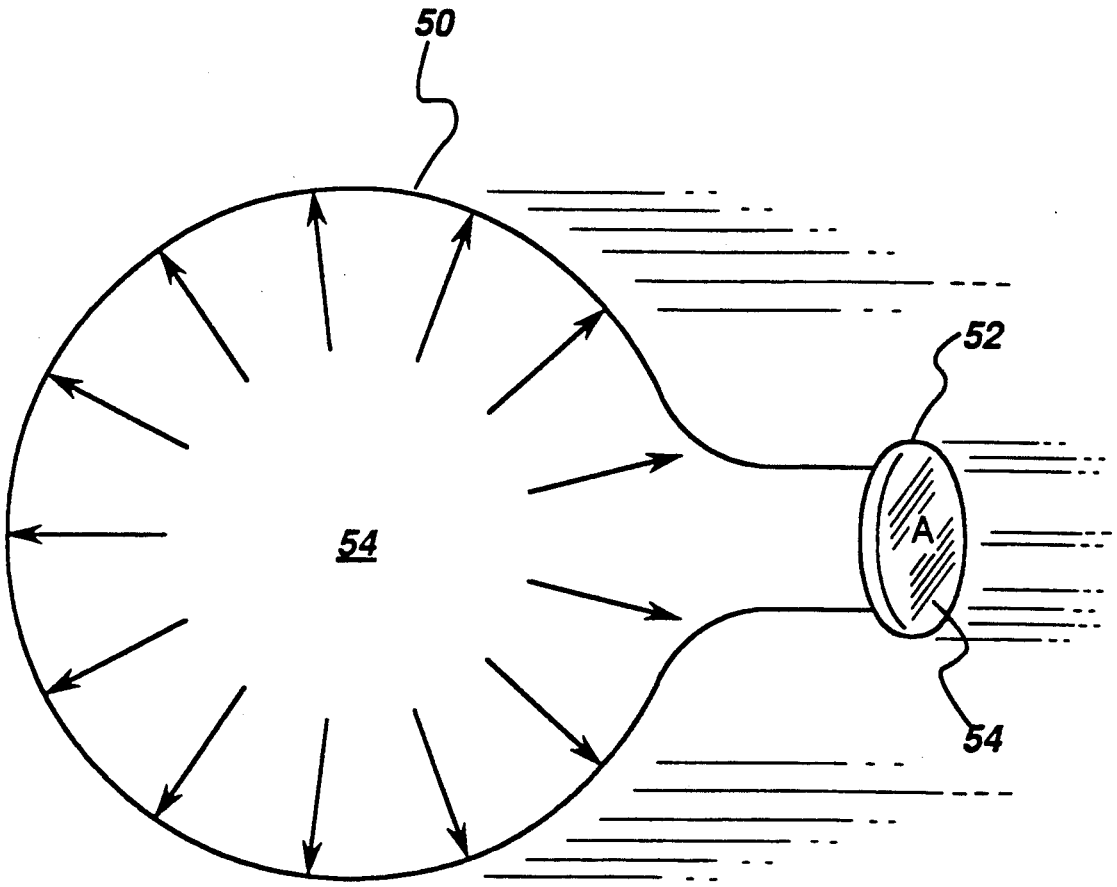
FIG. 2 is a schematic illustration of the balloon measuring technique used to determine the reaction force, according the present invention.

FIG. 2 shows a balloon 50 being jettisoned by a stream of air 54 from its mouthpiece 52. The reaction force (F) is the sum of the pressure (P) inside balloon 50 acting over the inside surface area of balloon 50. The pressure (P) acts equally everywhere except at the mouthpiece 52. The absence of force over the exit area 52 results in a net reaction force acting to propel the balloon 50 away from the mouthpiece 54. The magnitude of this force (F) is the pressure (P) inside the balloon times the exit area (A):

$$F=P\times A \tag{3}$$

This same principle applies to pressure pot shot peening nozzle 38. The reaction force acting on the nozzle 38 equals the pressure inside the nozzle 38 times the nozzle cross sectional area. Validation of this principle can be readily ascertained by noting that the nozzle 38 used in the tests described in Tables 1 and 2 had a $\frac{3}{8}$" exit diameter. Its cross sectional area was therefore 0.11 square inch. If the pressure ($P_2$), at the nozzle is multiplied by this area it is clear that a result closely approximating the measured reaction force is obtained, verifying the principle of the disclosure.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for controlling and monitoring pressure pot shot peening machines having a pressure pot, shot, air, a shot mass flow controller, a pressure pot gun nozzle, and a pressure sensing means, wherein said method is comprised of the steps of:

introducing shot and air into said pressure pot;

determining a shot mass amount by said shot mass flow controller;

ejecting said shot and air from said gun nozzle towards a workpiece;

determining an exit area of said gun nozzle;

determining a pressure to said gun nozzle;

determining a force of said shot, according to the equation:

$$F=P\times A$$

where

F=the force of the shot;

P=pressure at the gun nozzle

A=the exit area of the gun nozzle determining a shot velocity of said shot, according to the equation:

$$v=F/R$$

where v=average velocity of the shot;

F=the force of the shot; and

R=shot mass amount; and adjusting, if necessary said amount of shot and air introduced into said pressure pot.

* * * * *